US005295765A

United States Patent [19]

Choi

[11] Patent Number: 5,295,765

[45] Date of Patent: Mar. 22, 1994

[54] SNORKELING VEST

[75] Inventor: Moon Y. Choi, Placentia, Calif.

[73] Assignee: Under Sea Industries, Inc., Rancho Dominguez, Calif.

[21] Appl. No.: 738,449

[22] Filed: Jul. 31, 1991

[51] Int. Cl.[5] ..... B63C 9/24

[52] U.S. Cl. ..... 405/186; 441/102; 441/106; 441/117

[58] Field of Search ..... 405/186; 441/88, 102, 441/106-108, 113-119; 2/2.1 R; 128/202.14

[56] References Cited

U.S. PATENT DOCUMENTS

| | | | |
|---|---|---|---|
| 4,052,762 | 10/1977 | Zawislak | 441/102 |
| 4,097,947 | 7/1978 | Kiefer | 441/116 |
| 4,137,585 | 2/1979 | Wright | 441/116 X |
| 4,498,882 | 2/1985 | Evert | 441/116 |
| 4,523,914 | 6/1985 | Faulconer et al. | 441/108 |
| 4,752,263 | 6/1988 | Pritchard et al. | 441/88 |
| 5,011,334 | 4/1991 | Vorhauer | 405/186 |
| 5,020,941 | 6/1991 | Bulin et al. | 405/186 |
| 5,046,894 | 9/1991 | Bergstrom | 405/186 |

*Primary Examiner*—Dennis L. Taylor
*Assistant Examiner*—John Ricci
*Attorney, Agent, or Firm*—Leonard Tachner

[57] ABSTRACT

A vest of the type having an inflatable bladder providing selectable degrees of buoyancy, such as for snorkeling. The vest comprises an elastic upper body garment for encircling the chest and back of the user and an airtight inflatable bladder, secured at discrete locations to the chest-covering region of the garment by at least a pair of elastic straps for limited movement relative to the garment. The bladder is substantially flat against the garment when deflated and is free to move relative to the garment while being inflated. Attachment of the bladder to the underlying garment is provided by means of a plurality of elastic straps which permits the relative movement of the bladder and the underlying vest-shaped garment. As a result, inflation of the bladder has little or no effect upon the fit of the underlying garment on the user. Attachment of the bladder and the underlying vest-shaped garment is also provided by an area of Velcro fasteners on the mating surfaces of the bladder and underlying garment. In the preferred embodiment of the invention a Velcro surface is on the back of an integral mesh pocket, formed at the lower-most portion of the frontal region of the bladder. An optional crotch member is provided to limit the movement of the vest on the user, particularly when the bladder thereof is inflated and the user is in the water.

10 Claims, 5 Drawing Sheets

SNORKELING VEST

BACKGROUND OF THE INVENTION

1. Field of the Invention

The present invention relates generally to the field of floatation devices or buoyancy compensators, and more specifically, to a snorkeling vest of improved comfort and utility which may be advantageously used by swimmers for selectively adjusting their buoyancy, particularly while snorkeling.

2. Prior Art

The sport of snorkeling is becoming ever more popular as more and more people realize the beauty of submerged animal and plant life one may observe with the aid of a face mask and a snorkeling tube. While snorkeling may be accomplished with or without the benefit of buoyancy compensating devices, it is usually less tiring and thus more enjoyable to carry out snorkeling with the aid of a buoyancy compensating device. An inflatable vest provides selectable buoyancy and relieves the swimmer of the need to concentrate on staying afloat, so that his or her snorkel tube extends above the surface of the water. Buoyancy compensating devices are well known in the swimming and diving art, as well as for use as safety devices, such as life jackets. Unfortunately, buoyancy compensating devices used for scuba diving and as safety devices, such as in life jackets, tend to be overly complex or quite bulky and thus not entirely suited to be worn for snorkeling which requires a significant amount of freedom of movement, particularly of the arms and chest. Furthermore, bulky buoyancy compensating devices, because of their weight and interference with the freedom of movement, typically are removed by the snorkeler when he or she exits the water even temporarily, because of the inherent incumberence of such bulky and heavy compensating devices. Even those buoyancy compensation devices which are more preferably configured for snorkeling activity, tend to be bulky and thus relatively uncomfortable in use because of the effect that an inflated bladder has on the fit of the buoyancy device on the user. The most relevant prior U.S. patents known to the applicant and that are relevant to the invention described herein include the following:

U.S. Pat. No. 4,097,947 to Kiefer discloses an inflatable, wearable flotation device which utilizes both front and back chambers containing a buoyant material, such as PVC foam, as well as a deflatable bladder located in two front panels. When the bladder is inflated, restraining devices are automatically opened by the force exerted by the expanding bladder. These restraining devices normally hold certain pleats in a closed configuration so that the pleats are held out of the way of the wearer during normal use. The restraining devices can be snaps or Velcro. The bladder can be inflated by oral inflation or by a $CO_2$ cartridge. In one embodiment of the invention disclosed therein, the bladder can be located outside the front chambers of the vest and held directly to the vest by restraining devices. However, there does not appear to be an actual physical separation of the bladder from the vest, except to the extent needed to inflate the bladder.

U.S. Pat. No. 4,498,882 to Everett relates to a hybrid personal flotation device having a mass of buoyant material, as well as an inflatable buoyancy chamber having an interior zone and a peripheral zone. A portion of the interior zone is cooperatively connected to the chest portion. The peripheral zone is unattached to the chest portion, whereby the peripheral zone may be folded and when the buoyancy chamber is folded, the buoyancy chamber covers a smaller area than when it is unfolded. A covering panel has outer edges releasably connected to the chest portion, whereby when the buoyancy chamber is uninflated, the outer edge of the covering panel is secured to the chest portion and the buoyancy chamber is folded and hidden from view by the covering panel. When the buoyancy chamber is inflated, the outer edges of the covering panel are released and the buoyancy chamber expands, unfolds and is visible.

U.S. Pat. No. 4,523,914 to Faulconer et al discloses a conformable buoyancy compensator having an outer textile material which encloses a bladder. The bladder provides a series of gussets in the front and back which divide the bladder into a pair of channels or airbags. The channels and gussets hold the back and front portions of the buoyancy compensator into snug relationship on the user's chest to prevent unwarranted expansion and extension of the buoyancy compensator.

U.S. Pat. No. 4,623,316 to Ratliff discloses a floatation vest which may be integrated with a scuba tank and backpack and which uses a parachute-style harness configured to assure that a user will float on the water surface in a stable head-up and out-of-the-water position.

U.S. Pat. No. 4,913,589 to Faulconer et al discloses a buoyancy compensator and backpack for divers which is relevant to the present invention because it provides an independent suspension described as a neoprene spider incorporating two respective shoulder resting areas and two respective belt or waiststrap areas.

Unfortunately, all of the aforementioned prior art, as well as all other prior art known to the applicant relevant to buoyancy compensating devices, comprises a structure which is too complex and a configuration which is too cumbersome to best serve the needs of a snorkeler for buoyancy control, while at the same time, providing a comfortable garment configuration that can be worn advantageously both in and out of the water.

SUMMARY OF THE INVENTION

The present invention comprises a snorkeling vest of the type having an inflatable bladder providing selectable degrees of buoyancy. The vest of the present invention is characterized by an elastic upper-body garment for encircling the chest and back of a user and an airtight inflatable bladder, secured at discrete locations to the chest-covering region of the garment by at least a pair of elastic straps for limited movement of the bladder relative to the garment, so that the bladder lies substantially flat against the garment when deflated, but is free to move relative to the garment, while being inflated. The garment is made preferably of a neoprene rubber material. In a preferred embodiment of the invention, the vest further comprises a crotch member which is releasably secured to the garment for limiting the movement of the vest, relative to a user's body, while in the water. The bladder is inflated and deflated by means of a valve tube which is accessible at the exterior of the bladder, but which is in fluid communication with the interior of the bladder. In addition to securing the bladder to the garment by means of a plurality of elastic straps, the preferred embodiment of the invention also utilizes another fastening means, namely Velcro, to secure the lower portion of the bladder to the vest, as well as to secure the releasable crotch member to the lower portion of the bladder. In addition, the preferred embodiment provides a mesh-type pocket which is accessible to the user by means of a zipper opening.

One of the key features of the present invention is its simplicity of construction and its reduction of bulk material as compared to the prior art. These features make it extremely comfortable for the user, both in and out of the water. Another key feature that renders the buoyancy vest of the present invention comfortable to wear both in and out of the water, is the movement capability of the bladder relative to the vest garment. This feature makes it possible to have virtually any degree of inflation in the vest bladder, without having it affect the fit of the vest garment on the user. More specifically, because of the manner in which the bladder attaches to the garment, namely by a plurality of elastic straps at discrete locations, it is entirely possible to inflate the bladder fully, without altering or affecting the fit between the garment and the user. Furthermore, the nature of the bladder configuration is such that when the bladder is fully deflated, it constitutes a thin planar member that fits substantially flat against the garment so that the user is essentially unaware of wearing anything other than a comfortable neoprene vest garment, making the present invention extremely comfortable to wear out of the water as well.

OBJECTS OF THE INVENTION

It is therefore a principal object of the present invention to provide a snorkeling vest of novel configuration, simple structure and reduced material volume to provide a greater degree of wearer comfort, both in and out of the water.

It is an additional object of the present invention to provide an improved snorkeling vest comprising a neoprene rubber vest garment to which a bladder is attached at discrete locations along the chest portion thereof by, among other things, a plurality of elastic stretchable straps which permit relative movement of the bladder and the garment whereby the degree of inflation of the bladder does not affect the fit of the garment on the user.

It is still an additional object of the present invention to provide an improved snorkeling vest, the design of which is comfort oriented to reduce the complexity, volume and weight of the vest compared to prior art vests used by snorkelers.

BRIEF DESCRIPTION OF THE DRAWINGS

The aforementioned objects and advantages of the present invention, as well as additional objects and advantages thereof, will be more fully understood hereinafter as a result of a detailed description of a preferred embodiment when taken in conjunction with the accompanying drawings in which.

DETAILED DESCRIPTION OF A PREFERRED EMBODIMENT

Referring to the accompanying figures, it will be seen that a snorkel vest 10 of the present invention comprises a vest-shaped garment 12 and a bladder 14. Garment 12 may be characterized as an elastic upper-body garment which is configured for encircling the chest and back of the snorkeler in a vest-like configuration and having a fastener for securing the garment to the user. In a preferred embodiment of the invention, garment 12 is made of neoprene or other rubber-like material such as the neoprene wetsuit material commonly worn by scuba divers. The manner in which the bladder 14 is connected to the garment 12 constitutes one of the novel features of the present invention because it permits relative movement between the bladder and the garment during inflation and deflation of the bladder. Such relative movement permits the inflated bladder to have little or no effect on the fit of the garment on the user. Thus, the novel interconnection of the bladder and underlying vest-shaped garment of the present invention, provides a far more comfortable flotation device for snorkelers that may be worn both in and out of the water with minimum interference with normal motion of the body.

Figure 5:
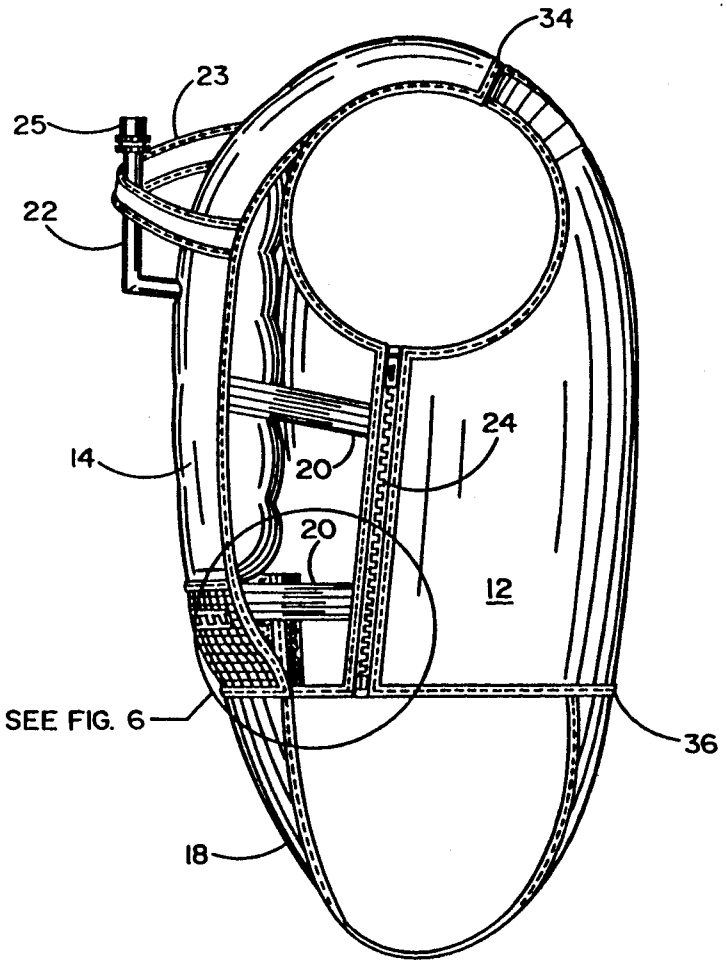
FIGS. 4 and 5 are side views of the present invention shown in its installed configuration in its deflated and inflated state, respectively.
Figure 4:
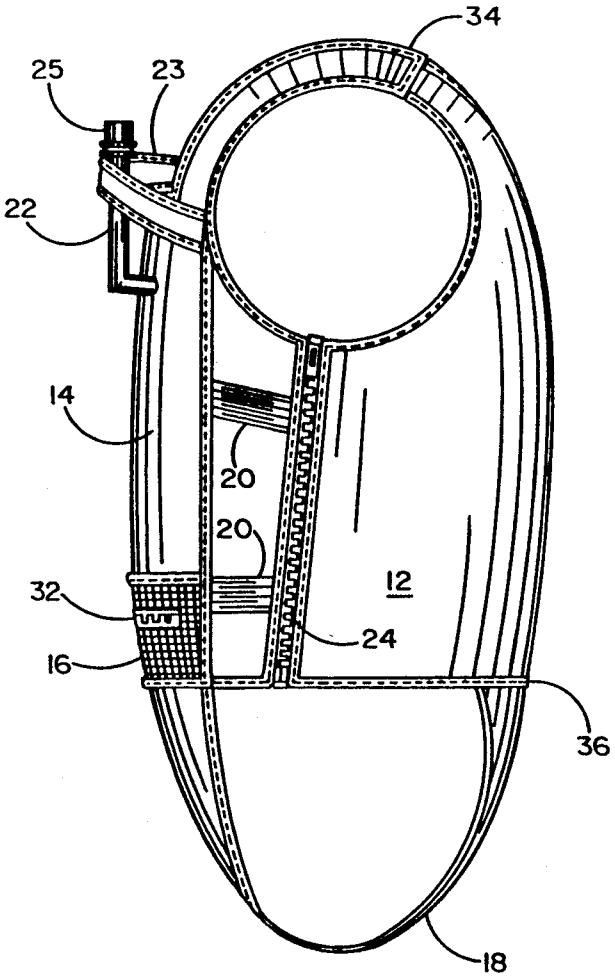
Figure 6:
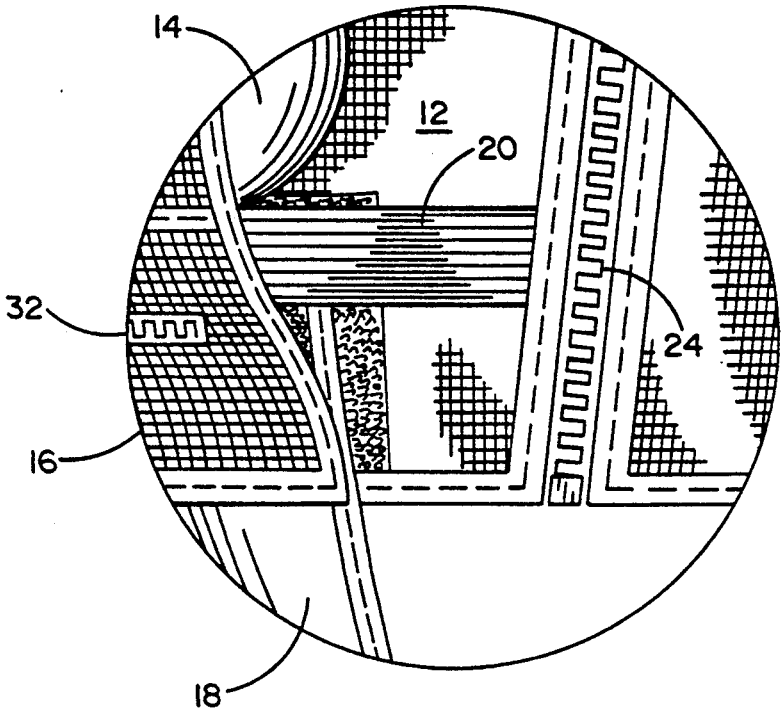
FIG. 6 is an enlarged view of a portion of the invention shown within the circle in FIG. 5, labelled "see FIG. 6".

More specifically, it will be seen in the accompanying figures that the bladder 14 is attached to the neoprene vest shaped garment 12 in the preferred embodiment of the accompanying figures at seven discrete locations, four of which are provided by a plurality of elastic straps 20. One end of each such strap is sewn to the garment 12 and the other end of each such strap 20 is sewn to an edge of the bladder 14. As seen best in FIGS. 1, 2 and 3-6, straps 20 are positioned along the sides of the garment 12, two such straps 20 being positioned at spaced apart locations at each side of the vest 10. Because of the elastomeric quality of the straps, when the bladder 14 is fully deflated and in a flattened condition, the straps 20 pull the bladder 14 toward the chest portion of the underlying vest shaped garment 12, so that the bladder lies substantially flat against the garment to minimize any interference with the comfort and mobility afforded by garment 12. On the other hand, as seen for example in FIG. 5, when the bladder 14 is inflated, straps 20 expand and their increased length permits the bladder 14 to inflate while permitting limited movement relative to the underlying garment 12, thereby minimizing the degree of impact on the fit of the underlying garment on the user even when the bladder 14 is expanded.

Figure 1:
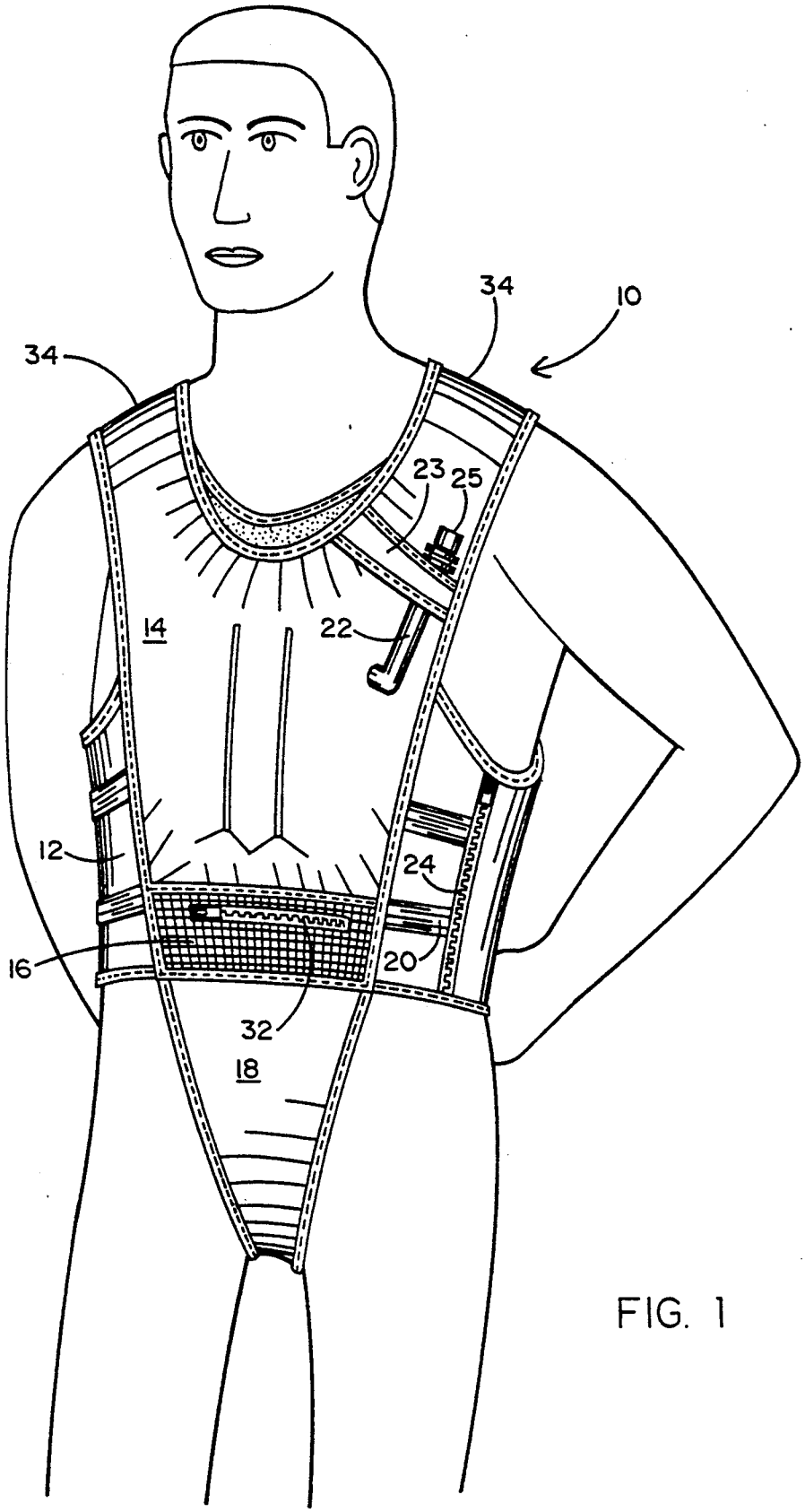
FIG. 1 illustrates the snorkeling vest of the present invention as shown from the front or chest region while being worn by a user.
Figure 2:
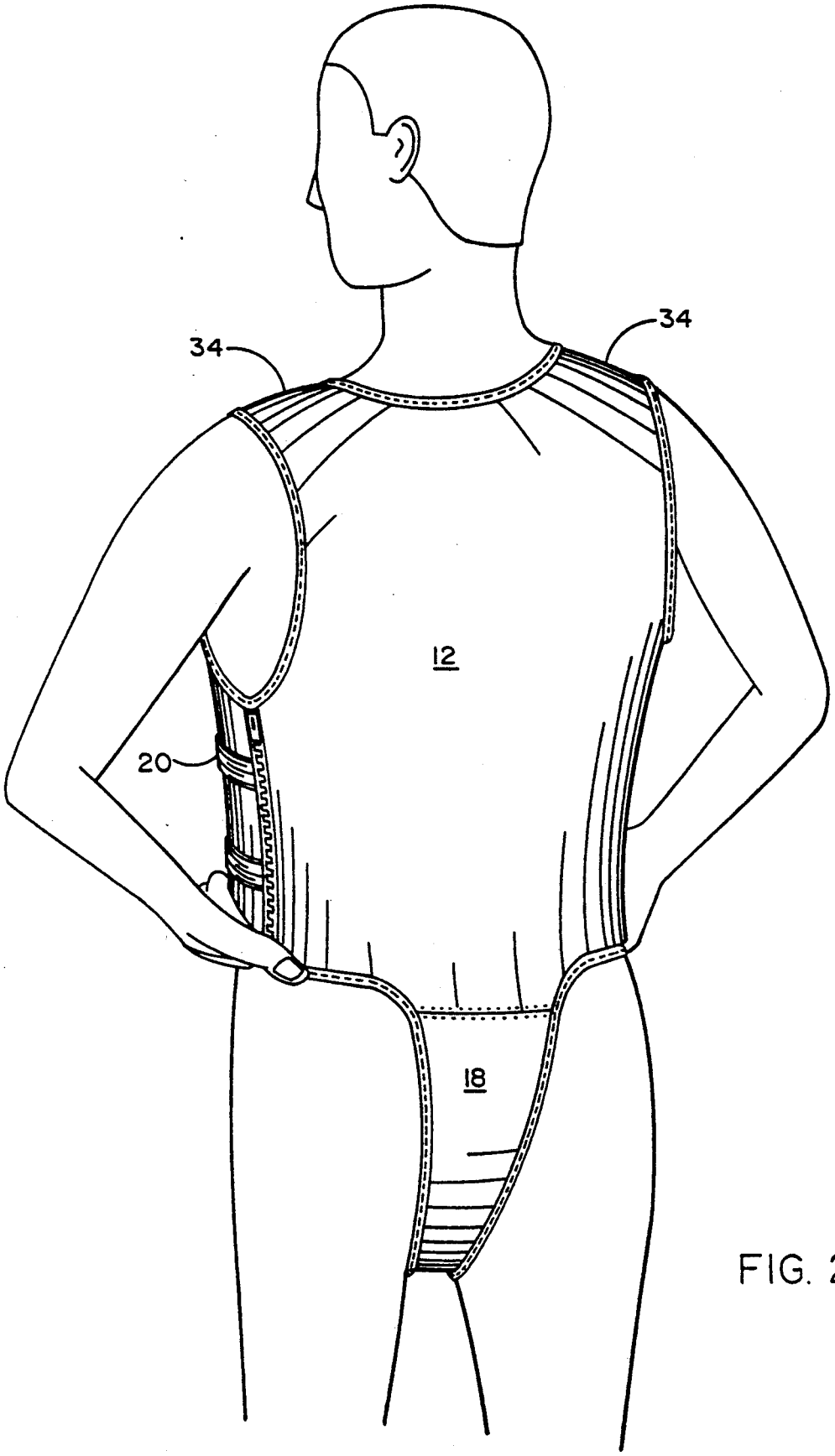
FIG. 2 is similar to FIG. 1, but illustrating the vest of the present invention from the back region.
Figure 3:
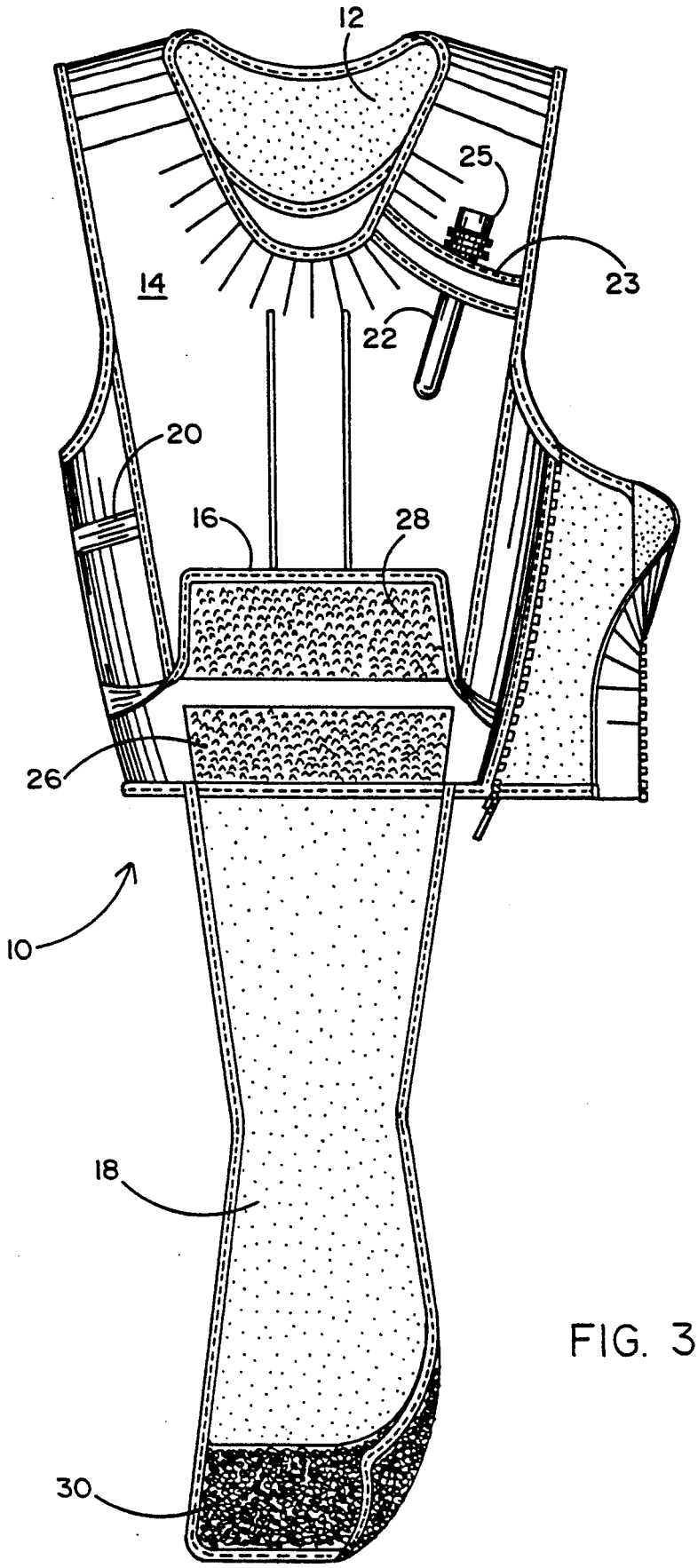
FIG. 3 is an elevational view of the vest of the present invention shown in a partially open configuration, separated from the user.

Other discrete connection locations between the bladder 14 and the underlying garment 12 occur at positions along the shoulders of the user when the vest 10 is worn as shown in FIGS. 1 and 2, namely at locations 34 at which the shoulder strap portion of the bladder is sewn along its edge to the shoulder portion of the underlying garment 12. The seventh discrete location for the attachment of the bladder 14 to the underlying vest shaped garment 12, occurs at the lower-most frontal position of the garment 12 and bladder 14, namely, beneath a mesh pocket 16 which is shown best in FIG.

1. Mesh pocket 16 forms the lower most portion of the bladder 14. The underside surface of mesh pocket 16 is provided with a fastening means 28, such as Velcro, and the underlying portion of the garment 12 is also provided with a fastening means 26 which is a mating form of Velcro in the preferred embodiment. Accordingly, releasable attachment of the bladder 14 to the underlying garment 12, along the underlying surface beneath mesh pocket 16, may be accomplished by simply pressing the two Velcro surfaces 26 and 28 against one another. It will be understood that because of the relative large surface area of fastening means 26 and 28 as seen best in FIG. 3, the user may selectively re-position the two mating surfaces by simply lifting the mesh pocket 16 and re-positioning it at a preferred location so that, for example, more slack may be provided in the relative positions of the garment 12 and the bladder 14 at the location of mesh pocket 16. Mesh pocket 16 is preferably provided with a zipper 32, seen best in FIG. 1, in order to provide the user with access to the interior of the pocket 16 for storage of miscellaneous articles therein, such as keys and the like.

In a preferred embodiment of the invention shown herein, an additional structured member is optionally provided to prevent the vest 10 from riding up on the user while the user is immersed in water. This additional crotch member 18 is attached at one end to the rearmost lower portion of garment 12 at a location 36 shown in FIGS. 4 and 5, but at the other end it is provided with Velcro fastening means 30 on both front and back surfaces thereof, so that it may be releasably adhered to the lower-most frontal portion of vest 10, between the surfaces 26 and 28 that would otherwise secure the lower-most portion of the bladder 14 to the underlying garment 12. This manner of connecting the crotch member 18 to the lower frontal portion of vest 10, obviates any requirement for additional securing means, thus avoiding any additional complexities to the overall structure. It also gives the user a degree of adjustability to vary the fit of the crotch member to comport with the comfort feature of the present invention.

Inflation and deflation of a bladder 14 are accomplished by means of an oral inflation tube 22 to which there is mounted a manual valve 25. Tube 22 is in fluid communication with the interior of bladder 14, but is positioned exterior thereto to permit the user a convenient means for inserting the valve end of the tube into his mouth for inflating the bladder or for simply adjusting the valve to an open position to release the air within the bladder for deflation thereof. An epaulette 23 secures tube 22 to the bladder.

It will now be understood that what has been disclosed herein comprises a vest of the type having an inflatable bladder providing selectable degrees of buoyancy, such as for snorkeling. The vest of the present invention comprises an elastic upper body garment for encircling the chest and back of the user and an airtight inflatable bladder, secured at discrete locations to the chest covering region of the garment by at least a pair of elastic straps for limited movement relative to the garment. The bladder is substantially flat against the garment when deflated and is free to move relative to the garment while being inflated. Novel means for attachment of the bladder to the underlying garment are provided in the present invention by means of a plurality of elastic straps which permits the relative movement of the bladder and the underlying vest-shaped garment. As a result, inflation of the bladder has little or no effect upon the fit of the underlying garment on the user.

The underlying garment is preferably made of a neoprene or other rubber-like material such as used in wetsuits for scuba divers. An additional discrete location for attachment of the bladder and the underlying vest-shaped garment is provided by an area of fastening means such as Velcro fastening means on the mating surfaces of the bladder and underlying garment. In the preferred embodiment of the invention this fastening means Velcro surface is on the back of an integral mesh pocket, formed at the lower-most portion of the frontal region of the bladder. An optional crotch member is provided to limit the movement of the vest of the present invention on the user, particularly when the bladder thereof is inflated and the user is in the water. The crotch member prevents the buoyancy of the inflated bladder from allowing the vest to ride up on the user, which might otherwise diminish the unique comfort features of the invention.

Those having skill in the art to which the present invention pertains, will now as a result of the applicant's teaching herein, perceive various modifications and additions which may be made to the invention. By way of example, the specific shapes, materials and configurations of the components of the snorkel vest disclosed herein may be readily altered while achieving the novel features thereof relating to comfort, simplicity of structure and reduction of interference with the user's movement. Furthermore, the specific manner shown herein for inflating and deflating the bladder, may be readily altered in a variety of well known ways, such as by providing CO bottles or other supplies of inflating gases therefor. Accordingly, it will be understood that all such modifications and additions are deemed to be within the scope of the invention which is to be limited only by the claims appended hereto and their equivalents.

I claim:

1. A snorkeling vest of the type having an inflatable bladder providing selectable degrees of buoyancy; the vest comprising:

an elastic upper-body garment for encircling the chest and back of a user and having a fastener for being secured thereto;

an air-tight inflatable bladder secured at discrete locations adjacent the intersection of the back-covering region and the chest-covering region of the garment by at least a pair of elastic straps for limited movement relative to the garment;

said bladder being substantially flat against the chest-covering region of said garment when deflated and being free to move relative to said chest-covering region of said garment while being inflated.

2. The vest recited in claim 1 wherein said garment is made of a rubber material.

3. The vest recited in claim 1 wherein said fastener comprises a zipper.

4. The vest recited in claim 1 further comprising a crotch member releasably secured to said garment for limiting the movement of said vest relative to a user's body.

5. The vest recited in claim 1 further comprising an accessible pocket integrally attached to said bladder.

6. The vest recited in claim 1 further comprising means for inflating and deflating said bladder.

7. A snorkeling vest for selectively altering the buoyancy of a user in water; the vest comprising:

an elastic garment for being worn on the user's upper body and having a chest-covering region and a back-covering region;

an air bladder secured to said garment at about the intersection of said chest-covering region and said back-covering region by at least one elastic strap for permitting movement of said bladder relative to said chest-covering region of said garment during inflation and deflation of said bladder; and a valved tube accessible exterior of said bladder and in fluid communication with the interior of said bladder for selective inflation and deflation thereof.

8. The vest recited in claim 7 wherein said garment is made of a rubber material.

9. The vest recited in claim 7 further comprising a crotch member releasably secured to said garment for limiting the movement of said vest relative to a user's body.

10. The vest recited in claim 7 further comprising an accessible pocket integrally attached to said bladder.

* * * * *